US005706641A

United States Patent [19]

Ishizaka

[11] Patent Number: 5,706,641

[45] Date of Patent: Jan. 13, 1998

[54] STEEL CORD HAVING LAYER-TWISTED STRUCTURE OF HELICOIDAL FILAMENTS FOR REINFORCING RUBBER PRODUCT

[75] Inventor: Hiroki Ishizaka, Kuroiso, Japan

[73] Assignee: Bridgestone Metalpha Corporation, Tokyo, Japan

[21] Appl. No.: 557,915

[22] Filed: Nov. 14, 1995

[30] Foreign Application Priority Data

Nov. 14, 1994 [JP] Japan ..... 6-302678
Feb. 13, 1995 [JP] Japan ..... 7-046620

[51] Int. Cl.[6] ..... D02G 3/36

[52] U.S. Cl. ..... 57/212; 57/213; 57/237; 57/902

[58] Field of Search ..... 57/902, 210, 211, 57/212, 213, 236, 237

[56] References Cited

U.S. PATENT DOCUMENTS

| | | | |
|---|---|---|---|
| 4,608,817 | 9/1986 | Brandyberry et al. | 57/902 |
| 4,628,683 | 12/1986 | Bourgois et al. | 57/902 |
| 4,707,975 | 11/1987 | Umezawa | 57/212 |
| 4,715,419 | 12/1987 | Kawasaki et al. | 152/527 |
| 4,756,151 | 7/1988 | Charvet | 57/213 |
| 4,763,466 | 8/1988 | Abe et al. | 57/213 |
| 5,024,261 | 6/1991 | Igarashi et al. | 152/527 |
| 5,050,657 | 9/1991 | Umezawa | 57/902 |
| 5,400,580 | 3/1995 | Kuriya et al. | 57/902 |
| 5,408,819 | 4/1995 | Nishimura et al. | 57/206 |
| 5,502,960 | 4/1996 | Kobayashi et al. | 57/236 |
| 5,526,864 | 6/1996 | Kuriya et al. | 57/902 |
| 5,584,169 | 12/1996 | Ikehara et al. | 57/212 |

FOREIGN PATENT DOCUMENTS

| | | |
|---|---|---|
| 194011A3 | 9/1986 | European Pat. Off. . |
| 627520A1 | 12/1994 | European Pat. Off. . |
| 59-124404 | 7/1984 | Japan . |

OTHER PUBLICATIONS

*High Tensile Strength Steel Cord Constructions For Tyres*, Research Disclosure, Aug. 1992.

*Primary Examiner*—William Stryjewski
*Attorney, Agent, or Firm*—Knobbe, Martens, Olson & Bear, LLP

[57] ABSTRACT

A steel cord which is suitable for reinforcing a rubber product and has excellent fatigue resistance. The steel cord has a layer-twisted structure formed by steel filaments respectively having a diameter of 0.15 mm to 0.25 mm. A core of the steel cord is formed by 1 to 4 steel filaments. A least 6 steel filaments are wound around the steel filaments of the core to form at least one layer. When the steel cord is bent from a straight state to a state in which a radius of curvature thereof is $d/(17\times10^{-3})$ wherein d is a diameter in millimeters of each steel filament in an outermost layer of the steel cord, a maximum amount of movement of each steel filament in the outermost layer in a cross-section of the steel cord is less than or equal to $(-0.5454d+0.1454)\times10^{3}$ um. The steel cord preferably has a two-layer-twisted structure or a three-layer-twisted structure, and has an arrangement in which the diameters of the steel filaments gradually decrease from the core to the outermost layer.

12 Claims, 4 Drawing Sheets

STEEL CORD HAVING LAYER-TWISTED STRUCTURE OF HELICOIDAL FILAMENTS FOR REINFORCING RUBBER PRODUCT

BACKGROUND OF THE INVENTION

1. Field of the Invention

The present invention relates to a steel cord having improved fatigue resistance and used to reinforce a rubber product such as a vehicle tire.

2. Description of the Related Art

Among vehicle tires, a heavy-duty tire requires control stability and comfort in the same way as a tire for a passenger vehicle. However, since it is strongly demanded that the heavy-duty tire has durability and recyclability, a steel cord used as a reinforcing material requires improved fatigue resistance.

For this reason, a cord obtained by twisting a plurality of steel filaments is used as a steel cord serving as a reinforcing material. Examples of the structure thereof include the following: a 1×12+1(3+9+1) structure in which one steel filament is wound around a structure obtained by simultaneously winding three steel filaments in a core portion and nine steel filaments in an outer layer portion around each other; a 1×27+1(3+9+15+1) structure in which one steel filament is wound around a structure obtained by simultaneously winding three central steel filaments, nine steel filaments in an intermediate portion, and fifteen steel filaments in an outer layer portion around each other; or a 1×19+1(1+6+12+1) structure in which one steel filament is wound around a structure obtained by simultaneously winding three central steel filaments, six steel filaments in an intermediate portion, and twelve steel filaments in an outer layer portion around each other. Such structures are used because the cord has excellent resistance to fatigue caused by abrasion occurring due to relative moving between steel filaments because the respective steel filaments are in line contact with each other. In addition, such layer-twisted structures have excellent strand productivity because a cord is completed in a single step of twisting wires, and is an economical rubber-reinforcing material.

With further improvement of durability of recent tires, it has been found that fatigue resistance deteriorates even if a steel cord having one of the above layer-twisted structures is used. More specifically, although the steel cord is repetitively bent by running of the tire, when the durability of the tire is improved, abrasion caused by repetitive bending of the steel filaments constituting the steel cord becomes marked, and the strength of the cord may decrease.

In particular, although one steel filament is wound around the outermost layer of the cord to hold the twisted state of the steel cord, it is found that the abrasion between this single steel filament and the wires in the outermost layer is made marked by repetitive bending. This abrasion can be prevented by removing the single steel filament wound around the outermost layer. In this case, however, the twisted state is disturbed, and fatigue resistance deteriorates. In a steel cord having a layer-twisted structure, it has been difficult to sufficiently improve fatigue resistance.

SUMMARY OF THE INVENTION

An object of the present invention is to provide a steel cord having a layer-twisted structure having improved fatigue resistance.

Another object of the present invention is to provide a steel cord having improved fatigue resistance in such a manner that deterioration of the strength of the steel cord caused by abrasion between steel filaments occurring due to repetitive bending and disturbance of the twisted state of the steel cord are prevented.

Still another object of the present invention is to provide a steel cord which is suitable for reinforcing a rubber product and reinforces the rubber product, and which has a long life, is economical, and is useful for resource saving.

An embodiment of a steel cord according to the present invention has a layer-twisted structure formed by steel filaments respectively having a diameter of from 0.15 mm to 0.25 mm, wherein a core of said steel cord is formed by 1 to 4 steel filaments, at least 6 steel filaments are wound around said core so as to form at least one layer, and when said steel cord is bent from a straight state to a state in which a radius of curvature of said steel cord is $d/(17\times10^{-3})$ wherein d is a diameter in millimeters of each steel filament in an outermost layer of said steel cord, a maximum amount of movement of each steel filament in the outermost layer in a cross-section of said steel cord is less than or equal to $(-0.5454d+0.1454)\times10^3$ um.

Following (1) through (4) are preferred examples of the steel cord for reinforcing a rubber product.

(1) The number of steel filaments in a core portion (to be referred to as core steel filaments hereinafter) is 1 to 4, and the number of steel filaments wound around a core (to be referred to as sheath steel filaments hereinafter) is 6 to 9.

(2) In the steel cord for reinforcing a rubber product having the arrangement (1), the relationship between a diameter dp of each core steel filament and a diameter dq of each sheath steel filament satisfies the relation $dp \geqq dq$.

(3) The number of core steel filaments is 1 to 4, the number of steel filaments wound around a core (to be referred to as inner-layer sheath steel filaments hereinafter) is 6 to 9, and the number of steel filaments wound around the inner-layer sheath wires (to be referred to as outer-layer sheath steel filaments hereinafter) is 11 to 15.

(4) In the steel cord for reinforcing a rubber product having the arrangement (3), the relationship among a diameter dp of each core steel filament, a diameter dq of each inner-layer sheath steel filament, and a diameter dr of each outer-layer sheath steel filament satisfies $dp \geqq dq \geqq dr$.

As another embodiment of a steel cord according to the present invention, there is provided a steel cord, having a layer-twisted structure formed by steel filaments respectively having a diameter of from 0.15 mm to 0.25 mm, wherein a core of said steel cord is formed by 1 to 3 steel filaments, at least 6 steel filaments are wound around said steel filaments of said core in the same direction and at the same twist pitch as a direction and twist pitch of said steel filaments of said core, and when said steel cord is bent from a straight state to a state in which a radius of curvature of said steel cord is $d/(17\times10^{-3})$ wherein d is a diameter in millimeters of each steel filament in an outermost layer of said steel cord, a maximum amount of movement of each steel filament in the outermost layer in a cross-section of said steel cord is less than or equal to $(-0.5454d+0.1454)\times10^3$ um.

Following (7) through (10) are preferred examples of the steel cord for reinforcing a rubber product.

(7) The number p of core steel filaments is 1 to 3, and the number q of sheath steel filaments is 6 to 9.

(8) In the steel cord for reinforcing a rubber product having the arrangement (7), the relationship between a diameter dp of each core steel filament and a diameter dq of each sheath steel filament satisfies $dp \geqq dq$.

(9) The number p of core steel filaments is 1 to 3, the number q of inner-layer sheath steel filaments is 6 to 9, and the number r of outer-layer sheath steel filaments is 11 to 15.

(10) In the steel cord for reinforcing a rubber product having the arrangement (9), the relationship among a diameter dp of each core steel filament, a diameter dq of each inner-layer sheath steel filament, and a diameter dr of each outer-layer sheath steel filament satisfies $dp \geqq dq \geqq dr$.

DESCRIPTION OF THE PREFERRED EMBODIMENTS

Figure 1A:
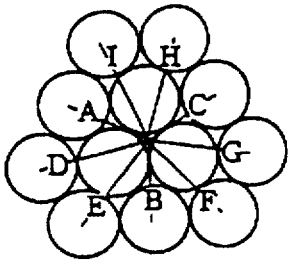
FIG. 1A is a sectional view showing a steel cord having a 1×12(8+9) layer-twisted structure in a straight state.

A steel cord according to one embodiment of the present invention is a steel cord for reinforcing a rubber product, having a layer-twisted structure formed by steel filaments respectively having a diameter of from 0.15 mm to 0.25 mm, wherein a core of said steel cord is formed by 1 to 4 steel filaments, at least 6 steel filaments are wound around said core so as to form at least one layer, and when said steel cord is bent from a straight state to a state in which a radius of curvature of said steel cord is $d/(17\times10^{-8})$ wherein d is a diameter in millimeters of each steel filament in an outermost layer of said steel cord, a maximum amount of movement of each steel filament in the outermost layer in a cross-section of said steel cord is less than or equal to $(-0.5454d+0.1454)\times10^3$ um.

In this case, the twisted structure of a steel cord for reinforcing a rubber product is limited to a compact structure as shown in FIGS. 5A to 5F because a twisted structure suitable for a rubber product, e.g., a heavy-duty tire, which requires cord strength and high fatigue resistance can be economically produced.

The diameter of each of the steel filaments constituting the steel cord of the present invention falls within the range of 0.15 mm to 0.25 mm for the following reason: when a steel filament having a diameter of smaller than 0.15 mm is used, fatigue resistance increases, but the manufacturing cost increases, and manufacturing energy increases so as to waste resources. On the other hand, when the diameter of each filament exceeds 0.25 mm, fatigue resistance decreases, and the filaments are not suitable as, for example, a material for reinforcing a heavy-duty tire.

The number of steel filaments constituting the core is 1 to 4. When the number exceeds 4, the arrangement of the steel filaments of the core strand is easily disturbed when the steel cord is bent, and fatigue resistance deteriorates. In addition, a gap in the core portion of the core strand increases in volume. When moisture reaches the steel cord through a crack formed in the tire, the moisture is propagates through the gap, and the moisture may corrode the steel filaments.

The amount of bending of the cord used when the maximum amount of movement of steel filaments in the outermost layer is measured is set such that a radius of curvature with respect to the diameter d of each steel filament in the outermost layer is $d/(17\times10^{-3})$. This value is obtained under the most severe condition when the steel cord is used as a material for reinforcing a rubber product such as a pneumatic tire, e.g., a condition for evaluating whether the steel cord is broken in running at a low inner pressure, i.e., a condition for evaluating the durability of the steel cord in running performed with a super flat tire having a low inner pressure. The value is determined on the basis of the fact that the magnitude of an external bending input and bending deformation of the steel cord caused by the external bending input depend on the diameter of each steel filament in the outermost layer.

The maximum amount of movement of each steel filament in the outermost layer, when the steel cord is bent from a straight state to a state, in which the radius of curvature of each steel filament in the outermost layer is $d/(17\times10^{-3})$, is $(-0.5454d+0.1454)\times10^3$ um or less in the steel cord cross-section. More specifically, when improvement in the fatigue resistance of the steel cord severely deformed by bending was examined, it was found that the amount of movement of each steel filament in the outermost layer obtained when the steel cord is deformed by bending relates to the fatigue resistance. The amount of movement with respect to the diameter of each steel filament in the outermost layer was measured, and these steel cords were subjected to a fatigue test, thereby obtaining a satisfactory fatigue resistance range. As a result, when the maximum amount of movement fell within the range expressed by the above expression, it was found that satisfactory durability could be obtained under the severe use condition. More specifically, when the value exceeds the range, the arrangement of the steel filaments in the outermost layer is disturbed, the degree of decrease in fatigue resistance increases, and the disturbance of the arrangement depends on the diameter of each steel filament in the outermost layer.

Note that, in order to make the maximum amount of movement of each steel filament in the outermost layer smaller than the value expressed by the above expression, the shaping rate of each steel filament may be controlled, or a means for soaking a predetermined amount of rubber into a steel cord may be used. The shaping ratio of the steel filament is set to be 90% or less. As the shaping ratio is small, the steel filament tends to be preferable with respect to the amount of movement of the steel filament. However, if the shaping ratio is excessively small, the twisted state of an end of the cord becomes faulty which leads to difficulties in the manufacture of rubber products. In addition, the soaking ratio of rubber into the steel cord is preferably set to be 80% or more. For this purpose, a gap for soaking rubber into the steel cord is formed between the respective steel filaments in the outermost layer. When the shaping ratio of an steel filament and the soaking rate of rubber are combined, the amount of movement of the steel filament can be further decreased.

Figure 2:
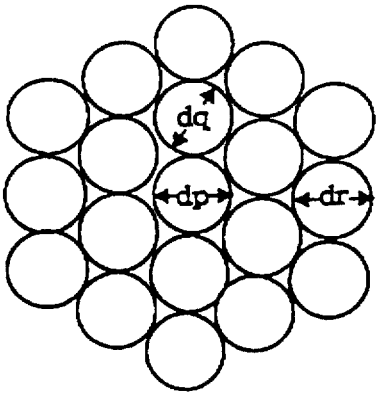
FIG. 2 is a sectional view showing the diameters of the steel filaments of a steel cord having a 1×19(1+6+12) three-layer-twisted structure.

In the present invention, all the diameters of the respective steel filaments constituting a steel cord may be equal to each other or different from each other depending on the layers. However, in a cord having a two-layer-twisted structure, the diameter dp of each core steel filament and the diameter dq of each sheath steel filament preferably satisfy the relationship expressed by $dp \geqq dq$, more preferably, satisfy the relationship expressed by $dq=(0.92 \text{ to } 1.0)\times dp$. In this case, the movement and fretting of each steel filament in the outermost layer can be preferably controlled. In addition, in a cord having a three-layer-twisted structure, as shown in FIG. 2, the diameter dp of each core steel filament, the diameter dq of each inner-layer sheath steel filament, and the diameter dr of each outer-layer sheath steel filament preferably satisfy the relationship expressed by $dp \geqq dq \geqq dr$, more preferably, satisfy the relationship expressed by $dr=(0.92 \text{ to } 1.0)\times dq$. In this case, as in the above case, the movement and fretting of each steel filament in the outermost layer can be preferably controlled.

In the steel cord, the twist pitch and twist direction are not limited. More specifically, even if the diameter of each steel filament, the twist pitch, and the twist direction are arbitrarily set, when the maximum amount of movement of each steel filament in the outermost layer falls within the above range, the effect of the present invention can be obtained.

As the material of steel filaments constituting the steel cord, among piano wires or hard steel wires defined by JIS G 3502 or JIS G 3506, a wire having a carbon content of 0.70 to 0.85% and a small amount of non-metallic inclusion is preferably used with respect to strength and a fatigue resistance.

In order to use the steel cord as a material for reinforcing a rubber product, the steel cord is preferably covered, e.g., plated with brass, to preferably adhere each steel filament and rubber to each other. In addition, an steel filament obtained by brass-plating a nickel-plated wire may be used to increase the corrosion resistance of the steel filament.

According to another embodiment of the present invention, there is provided a steel cord for reinforcing a rubber product, having a layer-twisted structure formed by steel filaments respectively having a diameter of from 0.15 mm to 0.25 mm, wherein a core of said steel cord is formed by 1 to 3 steel filaments, at least 6 steel filaments are wound around said steel filaments of said core in the same direction and at the same twist pitch as a direction and twist pitch of said steel filaments of said core, and when said steel cord is bent from a straight state to a state in which a radius of curvature of said steel cord is $d/(17\times10^{-3})$ wherein d is a diameter in millimeters of each steel filament in an outermost layer of said steel cord, a maximum amount of movement of each steel filament in the outermost layer in a cross-section of said steel cord is less than or equal to $(-0.5454d+0.1454)\times10^3$ um.

In this case, the number of core steel filaments of the cord is limited to 1 to 3 for the following reason: at least one steel filament is required to constitute the core, and when the number of steel filaments exceeds three, the arrangement of the core steel filaments is easily disturbed when the steel cord is bent, and the fatigue resistance is degraded.

In the present embodiment, as in the steel cord according to the previously-described embodiment, an amount of movement of steel filaments in the outermost layer must be limited. Note that, as in the previous description, the shaping ratio of the steel filaments is controlled to satisfy this condition. However, even if the shaping ratio of the respective steel filaments are made equal to each other or the shaping ratio of the steel filaments in different layers are different from each other, the effect of the present invention can be obtained when the maximum amount of movement of the steel filament in the outermost layer fall within the aforementioned ranges. For this reason, the shaping ratio are not limited to specific values.

Figure 5A:
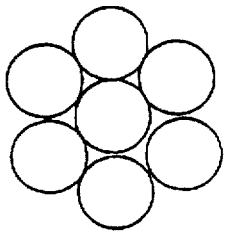
FIGS. 5A to 5F are sectional views of steel cords according to the present invention.
Figure 5B:
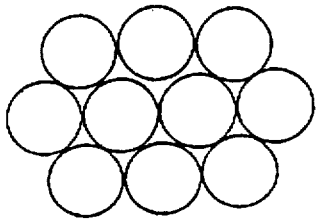
Figure 5C:
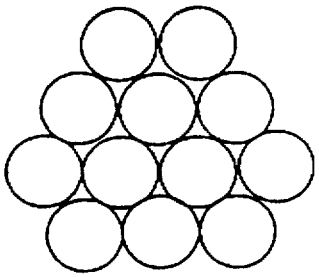
Figure 5D:
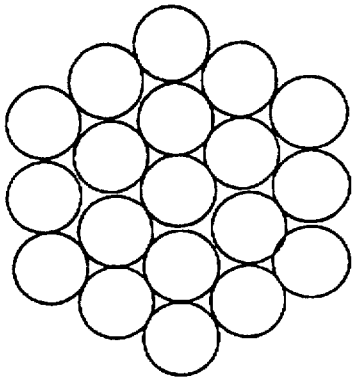
Figure 5E:
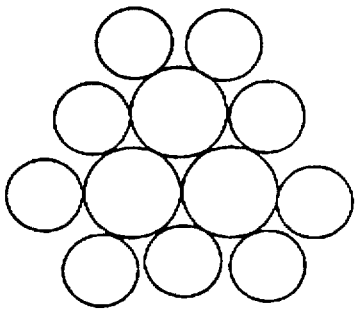
Figure 5F:
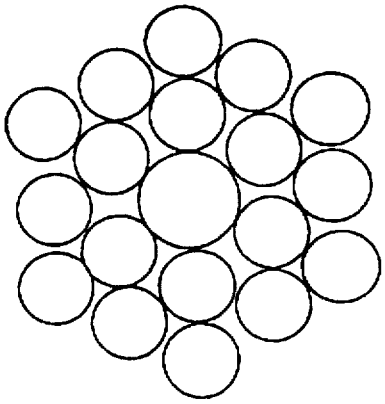

In the present invention, all of the diameters of the respective steel filaments constituting a steel cord may be equal to each other (e.g., FIGS. 5A to 5D) or different from each other depending on the layers (FIGS. 5E and 5F). However, in a cord having a two-layer-twisted structure, the diameter dp of each core steel filament and the diameter dq of each steel filament arranged around the core steel filaments preferably satisfy the relationship expressed by $dp \geqq dq$, more preferably, satisfy the relationship expressed by $dq=(0.92 \text{ to } 1.0)\times dp$. In this case, the movement and fretting of each steel filament in the outermost layer can be preferably controlled. In addition, in a cord having a three-layer-twisted structure, as shown in FIG. 2, the diameter dp of each core steel filament, the diameter dq of each steel filament arranged around the core steel filaments, and the diameter dr of each steel filament arranged around the steel filaments arranged around the core steel filaments preferably satisfy the relationship expressed by $dp \geqq dq \geqq dr$, more preferably, satisfy the relationship expressed by $dr=(0.92 \text{ to } 1.0)\times dq$. In this case, as in the above case., the movement and fretting of each steel filament in the outermost layer can be preferably controlled.

EXAMPLES

The present invention will be described below with reference to concrete examples. However, the present invention is not limited to the following examples.

A wire rod for a steel cord corresponding to an SWRH having a diameter of 5.5 mm was subjected to dry-type wire drawing, a plating process, and wet-type wire drawing to obtain a steel filament having a predetermined diameter, and various steel cords having layer-twisted structures shown in Table 1 were manufactured by a strand wire machine. Note that each steel filament was shaped by a pin-type shaping apparatus before the wires were twisted around each other in such a manner that the shaping ratio shown in Table 1 were set. The methods of calculating the shaping ratio, the maximum amount of movement of each steel filament in the outermost layer, and fatigue resistance will be described below.

Shaping Ratio

Figure 3A:
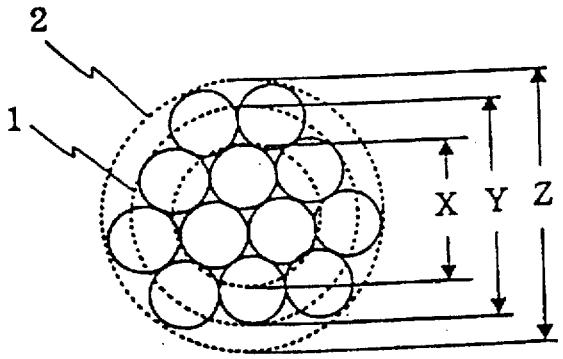
FIG. 3A is a sectional view showing a steel cord with a 1×12 two-layer-twisted structure having an inner layer, an outer layer 1 and an outer layer 2.
Figure 3B:
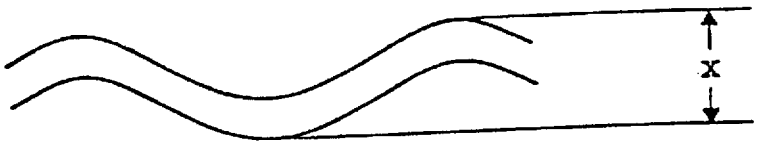
FIG. 3B is a side view showing a steel filament forming the inner layer, unfastened from the steel cord shown in FIG. 3A.
Figure 3C:
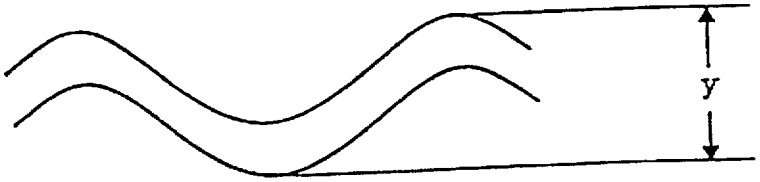
FIG. 3C is a side view showing a steel filament forming the outer layer 1, unfastened from the steel cord shown in FIG. 3A.
Figure 3D:
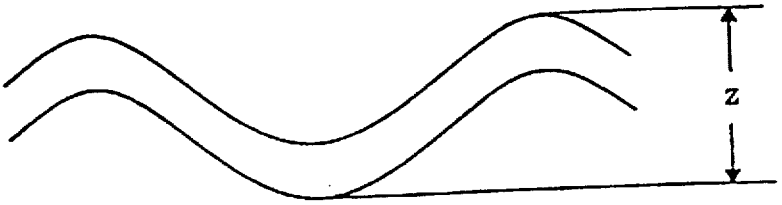
FIG. 3D is a side view showing a steel filament forming the outer layer 2, unfastened from the steel cord shown in FIG. 3A

Shaping Ratio be described with reference to a steel cord having a 1×12(3+9) two-layer-twisted structure. As shown in FIG. 3A, the diameter of the circumscribed circle of each of three steel filaments constituting the core portion is represented by X, the diameter of the circumscribed circle of each of three steel filaments (steel filaments constituting an outer layer 1) each of which is in contact with two of the steel filaments constituting the core portion is represented by Y, and the diameter of the circumscribed circle of each of six steel filaments (steel filaments constituting an outer layer 2) each of which is in contact with only one of the steel filaments constituting the core portion is represented by Z. Note that, in the present invention, "steel filaments in the outermost layer" means the steel filaments in the outer layers 1 and 2. As shown in FIGS. 3B, 3C, 3D, this steel cord is unfastened to obtain steel filaments, and the outer diameters of the steel filaments corresponding to the respective portions are represented by x, y, and z, respectively. On the basis of these actual values, shaping ratio were calculated according to the following expressions:

$$\text{Shaping ratio (\%) of steel filament of core portion}=(x/X)\times 100$$

$$\text{Shaping ratio (\%) of steel filament in outer layer 1}=(y/Y)\times 100$$

$$\text{Shaping ratio (\%) of steel filament in outer layer 2}=(z/Z)\times 100$$

Figure 4:
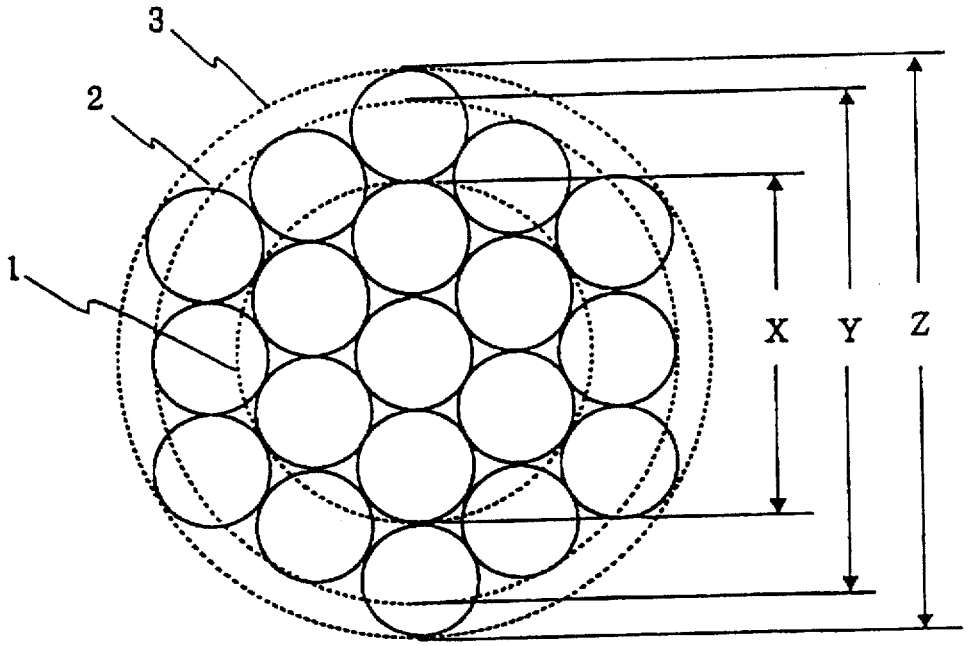
FIG. 4 is a view for explaining the shaping rates of the steel filaments of a steel cord having a 1×19 three-layer-twisted structure.

In a steel cord having, e.g., a 1×19(1+6+12) three-layer-twisted structure in which steel filaments of a core portion are not twisted around each other, as shown in FIG. 4, one steel filament is arranged as the core portion, and six steel filaments and twelve steel filaments are arranged in a sheath inner layer and a sheath outer layer, respectively, in such a manner that these steel filaments are twisted around each other. However, since the steel filament of the core portion is not twisted, the steel filament is not shaped. Therefore, in this case, since only the steel filaments in outer layers 1, 2, and 3 are twisted around each other (steel filaments in the outer layers 2 and 3 constitute "steel filaments in the outermost layer"), the shaping ratio of steel filaments corresponding to the portions X, Y, and Z shown in FIG. 4 are determined in the same way as described above.

A steel cord was sampled from a laboratory sample or a rubber product obtained by embedding the obtained sample steel cord in rubber and vulcanizing the resultant structure, and a sample in a straight state and a sample obtained by bending the steel cord corresponding to the sample at the radius of curvature defined according to the diameter of each steel filament in the outermost layer were embedded in a resin for measuring a metal tissue. Thereafter, the resin was hardened, the section of the sample steel cord was observed, and the maximum amount of movement of each steel filament in the outermost layer was calculated by the following method.

Maximum Amount of Movement of Steel Filament in Outermost Layer

A method of calculating the maximum amount of movement of each steel filament in the outermost layer will be described below with reference to FIG. 1.

Figure 1B:
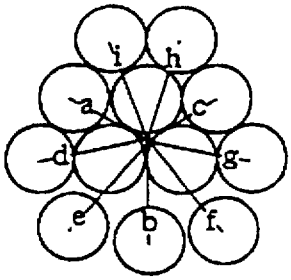
FIG. 1B is a sectional view showing the steel cord when the steel cord is bent under predetermined conditions.

FIG. 1A shows the section of a steel cord having a 1×12(3+9) two-layer-twisted structure in a straight state, and FIG. 1B shows the section of the steel cord in a bent state. In this case, the positions of the straight steel filaments in the outermost layer were measured as distances A to C and distance D to I between a cord axial core and the centers of the respective steel filaments in the outermost layer, and respective average values were determined as $L_1$ and $L_2$ on the basis of the following expressions:

$$L_1=(A+B+C)/3$$

$$L_2=(D+E+F+G+H+I)/6$$

When the cord was bent at a radius of curvature based on the above expressions defined by the diameter d of each steel filament in the outermost layer, the distance a through the distance i, between the cord axial core and the centers of the respective steel filaments in the outermost layer were measured. The largest value in values calculated by subtracting the average distance $L_1$ from each of the distances a through c and subtracting the average distance $L_2$ from each of the distances d through i was set as the maximum amount of movement.

Fatigue Resistance

In fatigue tests 1 and 2 described below, a steel cord to be tested was embedded in a rubber sheet, and strip-like test samples were manufactured. The method of testing was carried out in accordance with JIS-L-1017.

As conditions of fatigue test 1, after the water content in each test sample was controlled to 1.3%, the number of times of bending performed until each test sample was broken at a tensile load of 1 kg/cord on each sample, a pulley diameter of 18 to 28 mm, a temperature of 55° C., and a relative humidity of 95% was recorded.

TABLE 1

| | Twisted structure | Twist direction | Twist pitch (mm) | Shaping ratio (%) |
|---|---|---|---|---|
| Comparative example 1 | 3 + 9 × 0.23(mm) + 1 × 0.15(mm) | S/S/Z | 6/12 | 100/100 |
| Comparative example 2 | 3 + 9 × 0.23(mm) | S/S | 6/12 | 100/100 |
| Example 1 | 3 + 9 × 0.23(mm) | S/S | 6/12 | 100/80 |
| Example 2 | 3 + 8 × 0.23(mm) | S/S | 6/12 | 100/80 |
| Comparative example 3 | 3 + 9 + 15 × 0.175(mm) + 1 × 0.15(mm) | S/S/Z/S | 5.5/10.5/15.5/3.5 | 90/90/100 |
| Comparative example 4 | 3 + 9 + 15 × 0.175(mm) | S/S/Z | 5.5/10.5/15.5 | 90/90/100 |
| Example 3 | 3 + 9 + 15 × 0.175(mm) | S/S/Z | 5.5/10.5/15.5 | 90/90/80 |
| Example 4 | 3 + 9 + 14 × 0.175(mm) | S/S/Z | 5.5/10.5/15.5 | 90/90/80 |
| Example 5 | 4 + 9 + 14 × 0.175(mm) | S/S/Z | 5.5/10.5/15.5 | 90/90/80 |
| Comparative example 5 | 1 + 6 + 12 × 0.165(mm) | —/S/S | —/5.5/11.0 | —/90/100 |
| Example 6 | 1 + 6 + 12 × 0.165(mm) | —/S/S | —/5.5/11.0 | —/90/80 |
| Example 7 | 1 + 6 + 11 × 0.165(mm) | —/S/S | —/5.5/11.0 | —/90/80 |

The test value of a steel cord having a 1×12(3+9) two-layer-twisted structure is expressed as an index assuming that the number of times of bending performed until a conventional steel cord serving as comparative example 1 is broken is set to be 100. The test value of a steel cord having a 1×19(1+6+12) three-layer-twisted structure is expressed as an index assuming that the number of times of bending performed until a conventional steel cord serving as comparative example 3 is broken is set to be 100. The test value of a steel cord having a three-layer-twisted structure having one steel filament is expressed as an index assuming that the number of times of bending performed until a conventional steel cord serving as comparative example 5 is broken is set to be 100. The corrosion and fatigue resistances are in proportion to the indexes.

In fatigue test 2, each test sample was bent two million times at a tensile load of 7.5 kg/cord on each sample, a pulley diameter of 50 mm, a temperature of 50° C., and a relative humidity of 20%. A steel cord was taken from each test sample, and the strength of each steel filament constituting the steel cord was recorded. Each test value expresses a strength holding rate assuming that the strength of each steel filament before bending is set to be 100. Greater values indicate better fatigue resistance.

TABLE 2

| | Rubber soaking ratio (%) | Amount of movement of steel filament (μm) | (−0.5454d + 0.1454) × $10^3$ (μm) | Fatigue resistance: Fatigue test 1 | Fatigue resistance: Fatigue test 2 |
|---|---|---|---|---|---|
| Comparative example 1 | 0 | 25 | 20.0 | 100 | 90.5 |
| Comparative example 2 | 0 | 50 | 20.0 | 82 | 95.2 |
| Example 1 | 0 | 18 | 20.0 | 132 | 96.3 |
| Example 2 | 92 | 14 | 20.0 | 138 | 95.1 |
| Comparative example 3 | 0 | 60 | 50.0 | 100 | 89.1 |
| Comparative example 4 | 0 | 97 | 50.0 | 89 | 92.9 |
| Example 3 | 0 | 48 | 50.0 | 109 | 93.2 |
| Example 4 | 82 | 42 | 50.0 | 121 | 94.6 |
| Example 5 | 91 | 38 | 50.0 | 123 | 93.9 |
| Comparative example 5 | 0 | 98 | 55.4 | 100 | 92.1 |
| Example 6 | 0 | 47 | 55.4 | 111 | 93.3 |
| Example 7 | 92 | 41 | 55.4 | 119 | 93.6 |

As is apparent from the above test results, the steel cord according to the present invention is better than each of the conventional steel cords in corrosion resistance and fatigue resistance.

Steel cords according to embodiments in which 1 to 3 core steel filaments were arranged and twist conditions were defined were evaluated in the same manner as described above.

The test value of a steel cord having a 1×12(3+9) two-layer-twisted structure (FIG. 5E) in which the diameter of each steel filament of the core portion is 0.215 mm and the diameter of each steel filament arranged around the steel filaments arranged around the core portion is 0.20 mm is expressed as an index assuming that the number of times of bending performed until comparative example 6, in which spiral steel filaments are wound, is broken is set to be 100. The test value of a steel cord having a 1×19 different-wire-diameter compact twisted structure (FIG. 5F) in which the diameter of each steel filament of the core portion is 0.24 mm and the diameter of each steel filament arranged around the steel filaments arranged around the core portion is 0.225 mm is expressed as an index assuming that the number of times of bending performed until comparative example 8, in which spiral steel filaments are wound, is broken is set to be 100. The test value of a steel cord having a 1×12(3+9) equal-wire-diameter two-layer-twisted structure (FIG. 5C) in which the diameters of all the steel filaments are 0.20 mm is expressed as an index assuming that the number of times of bending performed until comparative example 10, in which spiral steel filaments are wound, is broken is set to be 100. The test value of a steel cord having a 1×10 compact twisted structure (FIG. 5B) in which the diameters of all the steel filaments are 0.23 mm and two core steel filaments are arranged is expressed as an index assuming that the number of times of bending performed until comparative example 12, in which spiral steel filaments are wound, is broken is set to be 100. The test value of a steel cord having a 1×7 equal-wire-diameter compact twisted structure (FIG. 5A) in which the diameters of all the steel filaments are 0.23 mm is expressed as an index assuming that the number of times of bending performed until comparative example 14, in which spiral steel filaments are wound, is broken is set to be 100. Greater values indicate better corrosion and fatigue resistances.

In fatigue test 2, each test sample was bent two million times at a tensile load of 7.5 kg/cord on each sample, a pulley diameter of 50 mm, a temperature of 50° C., and a relative humidity of 20%. A steel cord was taken from each test sample, and the strength of each steel filament constituting the steel cord was recorded. Each test value expresses a strength holding rate assuming that the strength of each steel filament before bending is set to be 100. Greater values indicate better fatigue resistance.

The obtained results are shown in Table 3.

TABLE 3

| | Twisted structure | Twist direction | Twist pitch (mm) | Shaping ratio (%) of steel filaments in core portion, outer layer 1, outer layer 2, and outer layer 3 |
|---|---|---|---|---|
| Comparative example 6 | 1 × 12 × (0.215/0.20) + 1 × 0.15(mm) | S/Z | 11/3.5 | 100/105/105 |
| Comparative example 7 | 1 × 12(0.215/0.20) | S | 11 | 100/105/105 |
| Example 8 | 1 × 12(0.215/0.20) | S | 11 | 90/85/85 |
| Comparative example 8 | 1 × 19(0.24/0.225) + 1 × 0.15 | S/Z | —/14/5 | —/90/100/100 |
| Comparative example 9 | 1 × 19(0.24/0.225) | S | —/14 | —/90/100/100 |
| Example 9 | 1 × 19(0.24/0.225) | S | —/14 | —/90/85/85 |
| Comparative example 10 | 1 × 12(0.20/0.20) + 1 × 0.15 | S/Z | 11/3.5 | 100/105/105 |

TABLE 3-continued

| | Twisted structure | Twist direction | Twist pitch (mm) | Shaping ratio (%) of steel filaments in core portion, outer layer 1, outer layer 2, and outer layer 3 |
|---|---|---|---|---|
| Comparative example 11 | 1 × 12(0.20/0.20) | S | 11 | 100/105/105 |
| Example 10 | 1 × 12(0.20/0.20) | S | 11 | 90/85/85 |
| Comparative example 12 | 1 × 10(0.23/0.23) + 1 × 0.15 | S/Z | 12/3.5 | —/100/100 |
| Comparative example 13 | 1 × 10(0.23/0.23) | S | 12 | —/100 |
| Example 11 | 1 × 10(0.23/0.23) | S | 12 | —/85 |
| Comparative example 14 | 1 × 7(0.23/0.23) + 1 × 0.15 | —/S | —/12 | —/105 |
| Comparative example 15 | 1 × 7(0.23/0.23) | —/S | —/12 | —/105 |
| Example 12 | 1 × 7(0.23/0.23) | —/S | —/12 | —/85 |

TABLE 4

| | Amount of movement of steel filament (μm) | (−0.5454d + 0.1454) × $10^3$ (μm) | Fatigue resistance | |
|---|---|---|---|---|
| | | | Fatigue test 1 | Fatigue test 2 |
| Comparative example 6 | 36 | 36.5 | 100 | 92.0 |
| Comparative example 7 | 52 | 36.5 | 70 | 96.5 |
| Example 8 | 30 | 36.5 | 105 | 97.0 |
| Comparative example 8 | 22 | 22.7 | 100 | 90.2 |
| Comparative example 9 | 40 | 22.7 | 91 | 93.3 |
| Example 9 | 20 | 22.7 | 109 | 94.1 |
| Comparative example 10 | 38 | 36.5 | 100 | 91.5 |
| Comparative example 11 | 54 | 36.5 | 74 | 95.0 |
| Example 10 | 32 | 36.5 | 106 | 96.0 |
| Comparative example 12 | 22 | 20.0 | 100 | 90.5 |
| Comparative example 13 | 38 | 20.0 | 69 | 92.6 |
| Example 11 | 19 | 20.0 | 102 | 93.2 |
| Comparative example 14 | 23 | 20.0 | 100 | 91.0 |
| Comparative example 15 | 47 | 20.0 | 87 | 93.2 |
| Example 12 | 18 | 20.0 | 104 | 93.9 |

As is apparent from the above test results, the steel cord according to the present invention is better than each of the conventional steel cords in corrosion resistance and fatigue resistance.

According to the present invention, when the numbers of core steel filaments and steel filaments in the outermost layer of a steel cord having a compact twisted structure constituted by steel filaments having predetermined diameters are specified, and the maximum amount of each steel filament in the outermost layer when the steel cord is bent under specific conditions is set to be equal to or smaller than a value falling within a specific range, excellent corrosion resistance and fatigue resistance can be obtained. Therefore, a rubber product which is reinforced by this steel cord has a very long life and is economical and effective in saving resources.

What is claimed is:

1. A steel cord having a layer-twisted structure for reinforcing a rubber product, comprising:

a core structure formed by 1 to 4 steel filaments each having a diameter of from 0.15 mm to 0.25 mm, said core structure having a cord axis; and a surrounding structure formed by at least 6 steel filaments each having a diameter of from 0.15 mm to 0.25 mm, said steel filaments being helicoidally twisted around said core structure, said filaments in said surrounding structure forming at least one layer, each layer forming a circumscribed circle defined by the distance between said cord axis and the center of each filament forming said layer, wherein each of said filaments in said surrounding structure has a helicoidal structure having a diameter with a shaping ratio of 80%–90% as measured when being unraveled, the shaping ratio being defined as the ratio of the diameter of said helicoidal structure of each filament to the diameter of the circumscribed circle of the layer including said filament, said shaping ratio being such that the degree of movement of each steel filament in said at least one layer from said cord axis is $(-0.5454d+0.1454)\times10^3$ μm or less, wherein d is a diameter in millimeters of said filament, as measured when said steel cord is bent from a straight state to a state in which a radius of curvature of said steel cord is $d/(17\times10^{-3})$.

2. A steel cord for reinforcing a rubber product according to claim 1, wherein the number of steel filaments wound around said steel filaments of said core is 6 to 9.

3. A steel cord for reinforcing a rubber product according to claim 2, wherein, given that a diameter of each steel filament of said core portion is represented by dp, and a diameter of each steel filament wound around said steel filaments of said core portion is represented by dq, the relation $dp \geqq dq$ is satisfied.

4. A steel cord for reinforcing a rubber product according to claim 1, wherein the number of steel filaments wound around said steel filaments of said core portion is 6 to 9, and the number of steel filaments wound around said steel filaments wound around said core portion is 11 to 15.

5. A steel cord for reinforcing a rubber product according to claim 4, wherein, given that a diameter of each steel filament of said core portion is represented by dp, a diameter of each steel filament wound around said steel filaments of said core portion is represented by dq, and a diameter of each steel filament wound around said steel filaments wound around said core portion is represented by dr, the relation $dp \geqq dq \geqq dr$ is satisfied.

6. A steel cord according to claim 1, further comprising a rubber soaked into said steel cord at a rubber-soaking ratio of 80% or higher, defined by the ratio of the volume of rubber soaked into the cord to the void formed among the filaments, wherein the number of steel filaments in said surrounding structure is selected to achieve said rubber-soaking ratio.

7. A steel cord having a layer-twisted structure for reinforcing a rubber product, comprising:

a core structure formed by 1 to 3 steel filaments each having a diameter of from 0.15 mm to 0.25 mm, said core structure having a cord axis; and a surrounding structure formed by at least 6 steel filaments each having a diameter of from 0.15 mm to 0.25 mm, said steel filaments being helicoidally twisted around said steel filaments of said core structure in the same direction and at the same twist pitch as the direction and twist pitch of said steel filaments of said core structure, said filaments in said surrounding structure forming at least one layer, each layer forming a circumscribed circle defined by the distance between said cord axis and the center of each filament forming said layer, wherein each of said filaments in said surrounding structure has a helicoidal structure having a diameter with a shaping ratio of 80%–90% as measured when being unraveled, the shaping ratio being defined as the ratio of the diameter of said helicoidal structure of each filament to the diameter of the circumscribed circle of the layer including said filament, said shaping ratio being such that the degree of movement of each steel filament in said at least one layer from said cord axis is $(-0.5454d+0.1454)\times10^3$ μm or less, wherein d is a diameter in millimeters of said filament, as measured when said steel cord is bent from a straight state to a state in which a radius of curvature of said steel cord is $d/(17\times10^{-3})$.

8. A steel cord for reinforcing a rubber product according to claim 7, wherein the number of steel filaments wound around said steel filaments of said core portion is 6 to 9.

9. A steel cord for reinforcing a rubber product according to claim 8, wherein, given that a diameter of each steel filament of said core portion is represented by dp, and a diameter of each steel filament wound around said steel filaments of said core portion is represented by dq, the relation $dp \geqq dq$ is satisfied.

10. A steel cord for reinforcing a rubber product according to claim 7, wherein the number of steel filaments wound around said steel filaments of said core portion is 6 to 9, and the number of steel filaments wound around said steel filaments wound around said core portion is 11 to 15.

11. A steel cord for reinforcing a rubber product according to claim 10, wherein, given that a diameter of each steel filament of said core portion is represented by dp, a diameter of each steel filament wound around said steel filaments of said core portion is represented by dq, and a diameter of each steel filament wound around said steel filaments wound around said core portion is represented by dr, the relation $dp \geqq dq \geqq dr$ is satisfied.

12. A steel cord according to claim 7, further comprising a rubber soaked into said steel cord at a rubber-soaking ratio of 80% or higher, defined by the ratio of the volume of rubber soaked into the cord to the void formed among the filaments, wherein the number of steel filaments in said surrounding structure is selected to achieve said rubber-soaking ratio.

* * * * *